US009320345B2

(12) United States Patent
Newton

(10) Patent No.: US 9,320,345 B2
(45) Date of Patent: Apr. 26, 2016

(54) SECURE CELL PHONE HOLDER

(71) Applicant: Giddy Up, LLC, Roswell, GA (US)

(72) Inventor: Joanna G. Newton, Roswell, GA (US)

(73) Assignee: Giddy Up, LLC, Roswell, GA (US)

( * ) Notice: Subject to any disclaimer, the term of this patent is extended or adjusted under 35 U.S.C. 154(b) by 36 days.

(21) Appl. No.: 14/228,343

(22) Filed: Mar. 28, 2014

(65) Prior Publication Data

US 2014/0361062 A1 Dec. 11, 2014

Related U.S. Application Data

(60) Provisional application No. 61/833,035, filed on Jun. 10, 2013.

(51) Int. Cl.

| | |
|---|---|
| ***A45F 5/02*** | (2006.01) |
| ***A45C 13/30*** | (2006.01) |
| *A45C 11/00* | (2006.01) |
| *A45F 5/00* | (2006.01) |

(52) U.S. Cl.

CPC . *A45F 5/02* (2013.01); *A45C 13/30* (2013.01); *A45C 2011/002* (2013.01); *A45F 2005/006* (2013.01); *A45F 2200/0516* (2013.01)

(58) Field of Classification Search

CPC ..... A45F 2005/023

USPC ..... 224/194–195, 254–256, 663–675, 224/901–901.8

See application file for complete search history.

(56) References Cited

U.S. PATENT DOCUMENTS

| | | | | |
|---|---|---|---|---|
| 2,474,495 | A | | 6/1949 | Pollack |
| 3,955,728 | A | * | 5/1976 | Jackson et al. ..... 224/417 |
| 4,446,997 | A | * | 5/1984 | Himberg ..... 224/578 |
| 4,905,857 | A | | 3/1990 | Her |
| 5,285,833 | A | | 2/1994 | Haxby |
| 5,289,619 | A | * | 3/1994 | Pileggi ..... 24/306 |
| 5,353,975 | A | | 10/1994 | Libertucci |
| 5,505,356 | A | * | 4/1996 | Noriega et al. ..... 224/250 |
| 5,511,704 | A | | 4/1996 | Linderer |
| 5,540,366 | A | | 7/1996 | Coomber |
| 5,551,496 | A | | 9/1996 | Gray |
| 5,645,205 | A | | 7/1997 | Kennedy |
| 5,775,561 | A | | 7/1998 | Kennedy |
| 5,878,441 | A | | 3/1999 | Busker et al. |
| 6,076,789 | A | | 6/2000 | Jackson |
| D439,040 | S | | 3/2001 | Vazquez |

(Continued)

OTHER PUBLICATIONS

Newton, Joanna G.; U.S. Provisional Application Entitled: Secure, Bounce-Free, Waterproof Cell Phone Holder for Athletes, Specifically Equestrians, U.S. Appl. No. 61/833,035, filed Jun. 10, 2013; 10 pgs.

(Continued)

*Primary Examiner* — Brian D Nash

(74) *Attorney, Agent, or Firm* — Taylor English Duma LLP

(57) ABSTRACT

A carrying case wearable by a user includes a pouch having an inner surface and an outer surface, the inner surface defining an interior carrying chamber, the inner surface and the outer surface defining an opening to provide access to the interior carrying chamber; a belt connected to the pouch, the belt sized to wrap around a pair of belt loops on a waist of the user. A method of using a carrying case having a pouch and a belt connected to the pouch includes wrapping the belt around a pair of belt loops on one side of a waist of a user; and securing the carrying case to the waist of the user

20 Claims, 9 Drawing Sheets

(56) References Cited

U.S. PATENT DOCUMENTS

| | | | | |
|---|---|---|---|---|
| D440,762 | S | 4/2001 | Sherman | |
| D446,928 | S | 8/2001 | Formica | |
| 6,435,392 | B1 | 8/2002 | Kennedy | |
| 6,473,941 | B2 | 11/2002 | Mei et al. | |
| 6,651,854 | B1 | 11/2003 | LaCoste | |
| 6,695,022 | B2 | 2/2004 | Morehead | |
| 6,698,636 | B2 | 3/2004 | Angus et al. | |
| D490,238 | S | 5/2004 | Bristel | |
| 6,883,694 | B2 | 4/2005 | Abelow | |
| D541,042 | S | 4/2007 | Andre et al. | |
| D553,853 | S | 10/2007 | Willows et al. | |
| D599,108 | S | 9/2009 | Brandenburg | |
| 8,157,140 | B2 * | 4/2012 | Jay | 224/666 |
| D666,409 | S | 9/2012 | Andre et al. | |
| D669,260 | S | 10/2012 | Davidson | |
| D676,232 | S * | 2/2013 | Manning et al. | D3/218 |
| D681,945 | S | 5/2013 | Willows et al. | |
| 8,474,669 | B2 | 7/2013 | Rohrbach et al. | |
| D691,794 | S | 10/2013 | Curran-Blaney et al. | |
| D692,230 | S | 10/2013 | Phillips et al. | |
| D695,007 | S | 12/2013 | Zhang | |
| D719,347 | S | 12/2014 | Newton | |
| 8,899,458 | B1 * | 12/2014 | Heien et al. | 224/675 |
| 2003/0218038 | A1 * | 11/2003 | Chang | 224/647 |
| 2005/0017040 | A1 | 1/2005 | Roberts et al. | |
| 2007/0215663 | A1 | 9/2007 | Chongson et al. | |
| 2009/0039120 | A1 * | 2/2009 | Murdoch et al. | 224/195 |
| 2010/0122995 | A1 * | 5/2010 | Thomas et al. | 224/681 |
| 2011/0226831 | A1 * | 9/2011 | Crifasi | 224/666 |
| 2012/0286012 | A1 * | 11/2012 | Flis | 224/665 |

OTHER PUBLICATIONS

Newton, Joanna G.; U.S. Design Application entitled: Secure Cell Phone Holder, having U.S. Appl. No. 29/479,504, filed Jan. 16, 2014, 7 pgs.

Smartpak; "Cell Phone Holder", located at <http://www.smartpakequine.com/cell-phone-holder-9501p> (Accessed Sep. 10, 2013), 4 pgs.

jaminleather.com; "Large Flap Top iPod & Smart Phone Case"; located at <http://www.jaminleather.com/Large-Flap-Top-iPod-Smart-Phone-Case-P2364.aspx> (Accessed Sep. 10, 2013), 2 pgs.

Newton, Joanna G.; Notice of Allowance for U.S. Appl. No. 29/479,504, filed Jan. 16, 2014, mailed Aug. 8, 2014, 13 pgs.

Newton, Joanna G.; Issue Notification for U.S. Appl. No. 29/479,504, filed Jan. 16, 2014, mailed Nov. 25, 2014, 1 pg.

* cited by examiner

SECURE CELL PHONE HOLDER

REFERENCE TO RELATED APPLICATIONS

This application claims priority to U.S. Provisional Application No. 61/833,035, titled "Secure, Bounce-Free, Waterproof Cell Phone Holder for Athletes, Specifically Equestrians," filed Jun. 10, 2013, which is hereby specifically incorporated by reference herein in its entirety.

TECHNICAL FIELD

This disclosure relates to carrying cases. More specifically, this disclosure relates to carrying cases for securely carrying personal items such as cell phones.

BACKGROUND

Over the last decade, owning and carrying a cell phone at all times has become necessary for most people in the United States. With the growing popularity of "smart phones," such as the iPhone™ and Droid™, having instant access to one's phone for many has become vital in order to not only be able to answer or make calls, but also to respond to emails and text messages, to maintain a calendar, to take pictures, to listen to music, and to utilize any number of the hundreds of thousands of "apps" that are now available. Though for many cell phone users, these functions are a convenience, for equestrians, having ready access to a cell phone, smart phone or other small items, is a matter of safety.

There is inherent risk associated with horseback riding. If a rider falls while riding alone, he or she may be seriously injured. At times, riders may be out on trails far away from the stable and in some cases miles away from a house or town where an injured rider could find someone to help him or to call for help. Therefore, riders really should have their own cell phone, securely attached to their body, in order to have a means of calling for help or communicating with other riders when needed.

Traditional cell phone holders/carriers, such as a simple belt clip, conveniently attach to the waistband of an individual's pants, but because they usually only attach to the waistband at a single point, they tend to bounce, and in doing so, interfere with a rider's ability to move comfortably. Moreover, because of this weak attachment, they may even come off during routine, low-intensity riding, and in the event of a fall from a horse, the phone will almost certainly be knocked free and lost or damaged, making it unusable. Other holders that go through a person's belt loops at the waist, such as the "Smart Phone Pouch," U.S. Pat. No. D676,232 (Manning), and other similar carriers are bulky, interfere with the rider's ability to move in the saddle, and would not be able to be used if a rider is trying to carry a phone discretely at a competition. Additionally, many of the aforementioned types of holders are not waterproof, which is important for riders, as they may be riding in rainy conditions or may have a fall into water (e.g. when crossing a stream). Holders that fasten to the rider's arm, such as U.S. Pat. No. D666,409 (Apple, Inc.), are uncomfortable to wear while riding because of the nature of arm use during the riding activity, are very hot when worn for long periods of time, and cannot be concealed under formal horse show attire. Similar style holders that attach to the rider's leg are at significant risk of being badly damaged or broken if a rider falls, and are often too small to fit a smart phone.

In addition, non-equestrians, including athletes, may also have the need to carry cell phones and other personal items during activities requiring prolonged movement. The activities of walkers, runners, hikers, cyclists, boaters, hang gliders, snow skiers, and others include prolonged movement where traditional carrying cases are undesirably insecure or inconvenient to wear during activity.

SUMMARY

Disclosed is a carrying case wearable by a user, the carrying case including a pouch having an inner surface and an outer surface, the inner surface defining an interior carrying chamber, the inner surface and the outer surface defining an opening to provide access to the interior carrying chamber; a belt connected to the pouch, the belt sized to wrap around a pair of belt loops on a waist of the user.

Also disclosed is a method of using a carrying case having a pouch and a belt connected to the pouch, the method including wrapping the belt around a pair of belt loops on one side of a waist of a user; and securing the carrying case to the waist of the user.

Embodiments of this disclosure may include a waterproof carrying case for a cell phone, smart phone, iPod™, or other handheld device. In addition, embodiments of this disclosure may include a case affixed to an adjustable belt that securely attaches to the waistband of pants by passing through the belt loops of the pants.

Embodiments of this disclosure may include a secure, waterproof case (hereinafter "pouch") affixed to an adjustable belt that can accommodate either a traditional cell phone or a smart phone or other handheld device, and attaches to the waistband of an individual's pants through the belt loops in order to resist bouncing while participating in an athletic activity, such as horseback riding.

In embodiments of this disclosure, the cell phone, smart phone, or other handheld device may be contained within a pouch that has a scratch-resistant inner surface to protect the screen of a handheld device and that is opened and closed with a zipper along the top side. A belt may be permanently affixed to the pouch such that the pouch is located between each end of the belt. Each end of the belt may be then threaded through any two belt loops, one belt loop situated proximate either side of the pouch. Once threaded through a belt loop on the individual's pants, wrapping the belt around the belt loop, the belt may then be attached to the pouch. The same attachment strategy may then be repeated with the other end of the belt such that each side of the belt may be attached to the other side of the belt by extending across the front side of the pouch or behind the back side of the pouch in order to secure the cell phone or other personal item or handheld device in place. In various embodiments, one end of the belt may be threaded through two belt loops, one belt loop situated proximate either side of the pouch, and may then be connected to the other end of the belt or to the pouch itself.

In various embodiments, the pouch and the belt may be made of material that may or may not be waterproof, has elastic strength, and is soft, so as not to damage the handheld device.

In various embodiments, the pouch is made of a soft waterproof material, as above, and the belt is made from a different material that has elastic strength and may or may not be waterproof.

In various embodiments, the pouch is made of a more rigid waterproof material with or without a soft inner lining to protect the screen of the handheld device. In these embodiments the belt may be made of an elastic material that may or may not be waterproof.

In various embodiments, the belt length may be adjustable and each end of the belt may be attached to the other with fastener such as a hook, a clasp, a snap, a button, or hook and loop fasteners such as Velcro™.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Disclosed is a cell phone holder, or "carrying case," and associated methods, systems, devices, and various apparatus. In various embodiments, the carrying case may be used to hold a handheld device, such as a cell phone or smart phone, or any other personal item, such as a wallet, credit cards, a stop watch, car keys, first aid kit, insulin kit, epinephrine autoinjector, other medical items, or any other personal items, and the use of the term "cell phone holder" should not be considered limiting. The carrying case includes a pouch and a belt. It would be understood by one of skill in the art that the disclosed carrying case is described in but a few exemplary embodiments among many. No particular terminology or description should be considered limiting on the disclosure or the scope of any claims issuing therefrom.

Figure 1A:
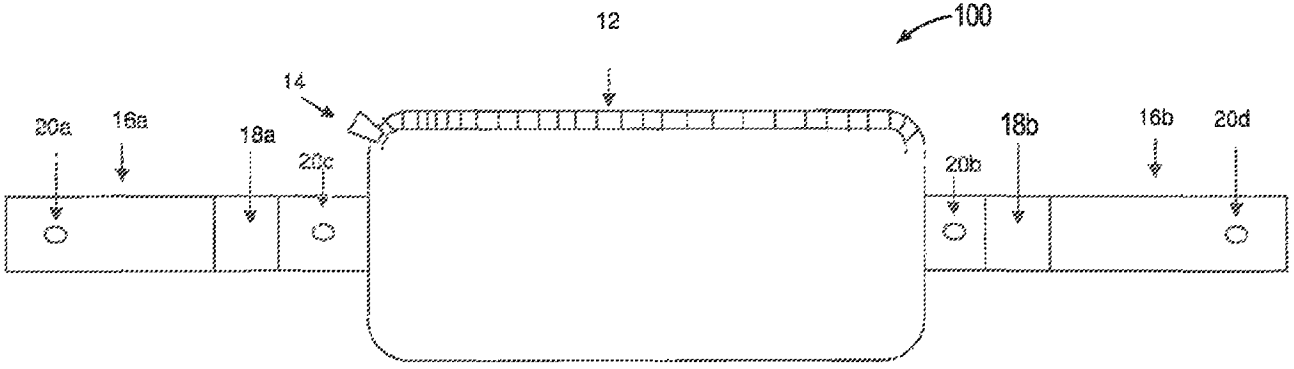
FIG. 1A is a front view of a carrying case in accordance with one embodiment of the current disclosure.
Figure 1B:
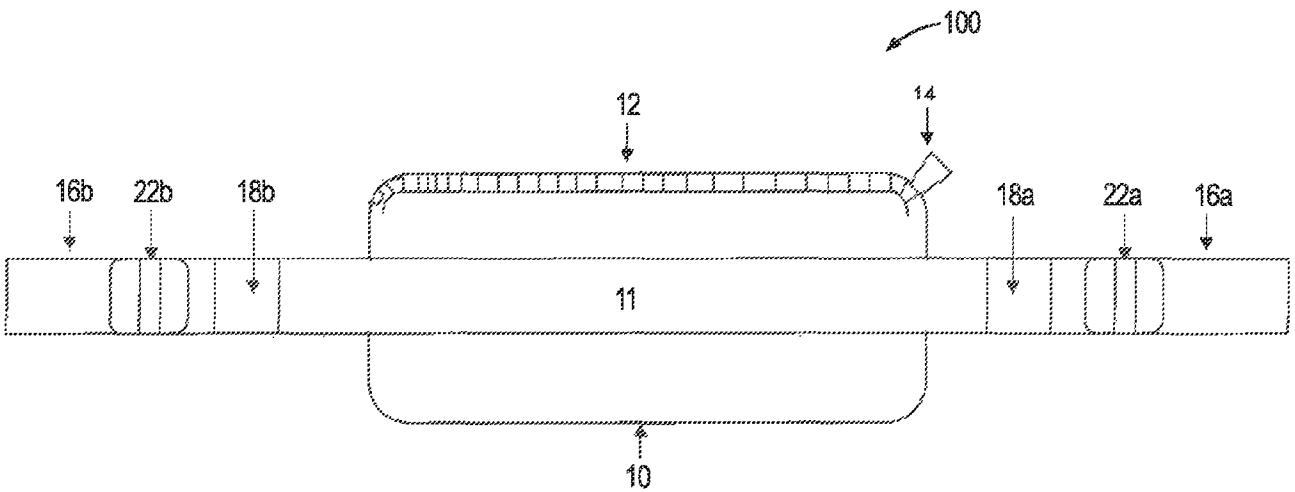
FIG. 1B is a back view of the carrying case of FIG. 1.

One embodiment of a carrying case 100 is disclosed and described in FIG. 1A. FIG. 1A shows a front view of the carrying case 100. In the current embodiment, carrying case 100 includes a pouch 10. The pouch 10 may be rectangular in shape and of a size that can accommodate any currently-available mobile device. The pouch 10 may be made from waterproof material that can either be soft or rigid. A zipper 12 lines a top side of the pouch 10 and is opened and closed with a pull tab 14. A belt 11 is permanently attached to a back side of the pouch 10, as shown in FIG. 1B, and extends outward on either side of the pouch 10, as shown in FIG. 1A. A left side 16*a* of the belt 11 and a right side 16*b* of the belt 11 are mirror images. The left side 16*a* is a first end of the belt 11 and the right side 16*b* is a second end of the belt 11. Components 20*a,b,c,d* make up the system by which the belt 11 is fastened together such that component 20*a* securely attaches to component 20*b* and component 20*d* securely attaches to component 20*c*. Components 18*a,b* are loops that are permanently attached to their respective sides of the belt 11, and will be discussed in further detail below with respect to FIG. 2.

FIG. 1B shows a back side of the carrying case 100. As shown in FIG. 1B, the belt 11, is a single strap permanently attached across the back of the pouch 10. In various embodiments, the belt 11 may be multiple straps, and the disclosure of a single strap should not be considered limiting. In various embodiments, the belt 11 may include a first strap attached to one side of pouch 10 and a second strap attached to a second side of pouch 10. Because it may be necessary to make the belt 11 an adjustable length, slides 22*a,b* are on each side of the belt 11 so that each side 16*a,b* can be adjusted shorter or longer independently.

Figure 2:
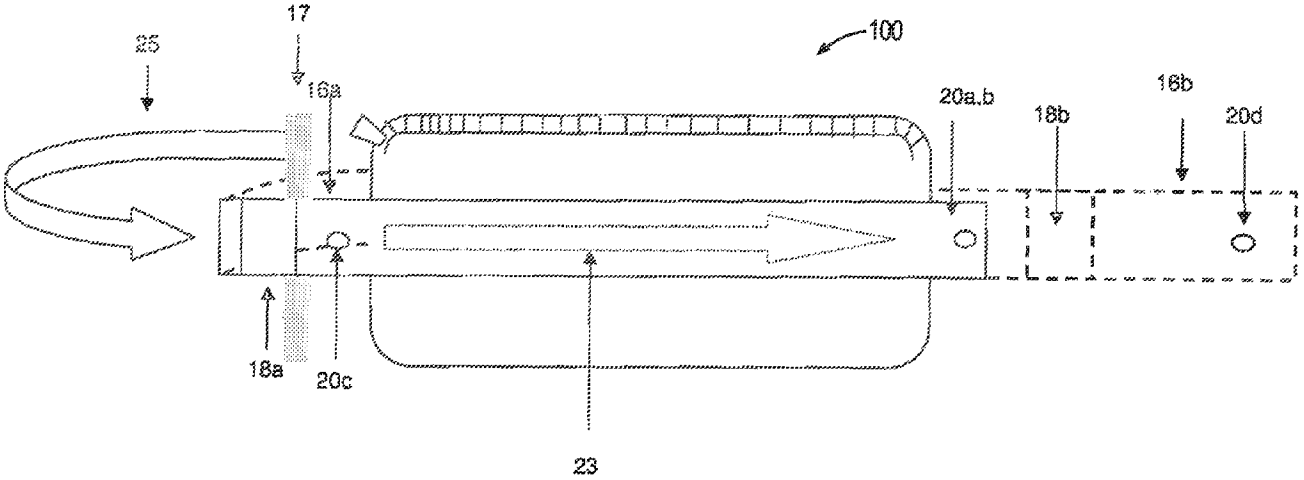
FIG. 2 is a back view of the carrying case of FIG. 1 showing how a belt of the carrying case securely attaches to a user's pants in accordance with one embodiment of the current disclosure.
Figure 3:
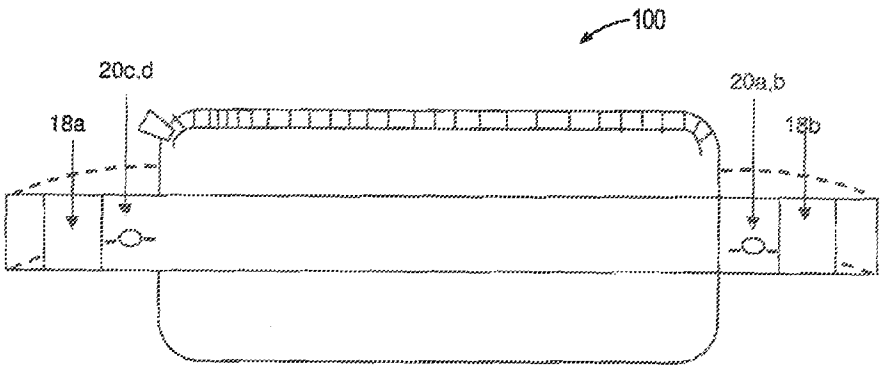
FIG. 3 is a back view of the carrying case of FIG. 1 showing the appearance of the carrying case when each side of the belt is fastened in place in accordance with one embodiment of the current disclosure.

FIG. 2 shows how the belt 11 is fastened across the front of the pouch 10 to hold it firmly in place against a person's or user's body. The left side 16*a* is threaded through a belt loop 17 on a person's or user's pants. Arrow 25 illustrates that the belt 11 folds back on itself, wrapping around belt loop 17, and threads through the loop 18*a*, which is permanently attached to the left side 16*a* of the belt 11. This loop 18*a* helps hold the belt 11 firmly against the person's waist, even after the belt 11 is stretched across the front of the pouch 10. Arrow 23 illustrates that the belt 11 is pulled firmly across the front of the pouch 10. The left side 16*a* of the belt 11 is fastened in place by the system shown in FIG. 1A where component 20*a* attaches to component 20*b*, as described above. In FIG. 2, this attachment is shown as components 20*a,b*. The same attachment process is then done with right side 16*b* using a different belt loop on the person's or user's pants. Thus the left side 16*a* of belt 11 is connected to the right side 16*b* of belt 11, and the belt 11 is sized such that the left side 16*a* may wrap around one belt loop, the right side 16*b* may wrap around a second belt loop, and the left side 16*a* and the right side 16*b* may be connectable between the first belt loop and the second belt loop. In the current embodiment, the first belt loop and the second belt loop are adjacent to each other or, in other words, there are no belt loops between the first belt loop and the second belt loop on the waist of the user. FIG. 3 shows the carrying case 100 fully fastened together, with component 20*a* attached to component 20*b*, denoted by components 20*a, b*, and with component 20*c* attached to component 20*d*, denoted by components 20*c,d*.

Figure 4:
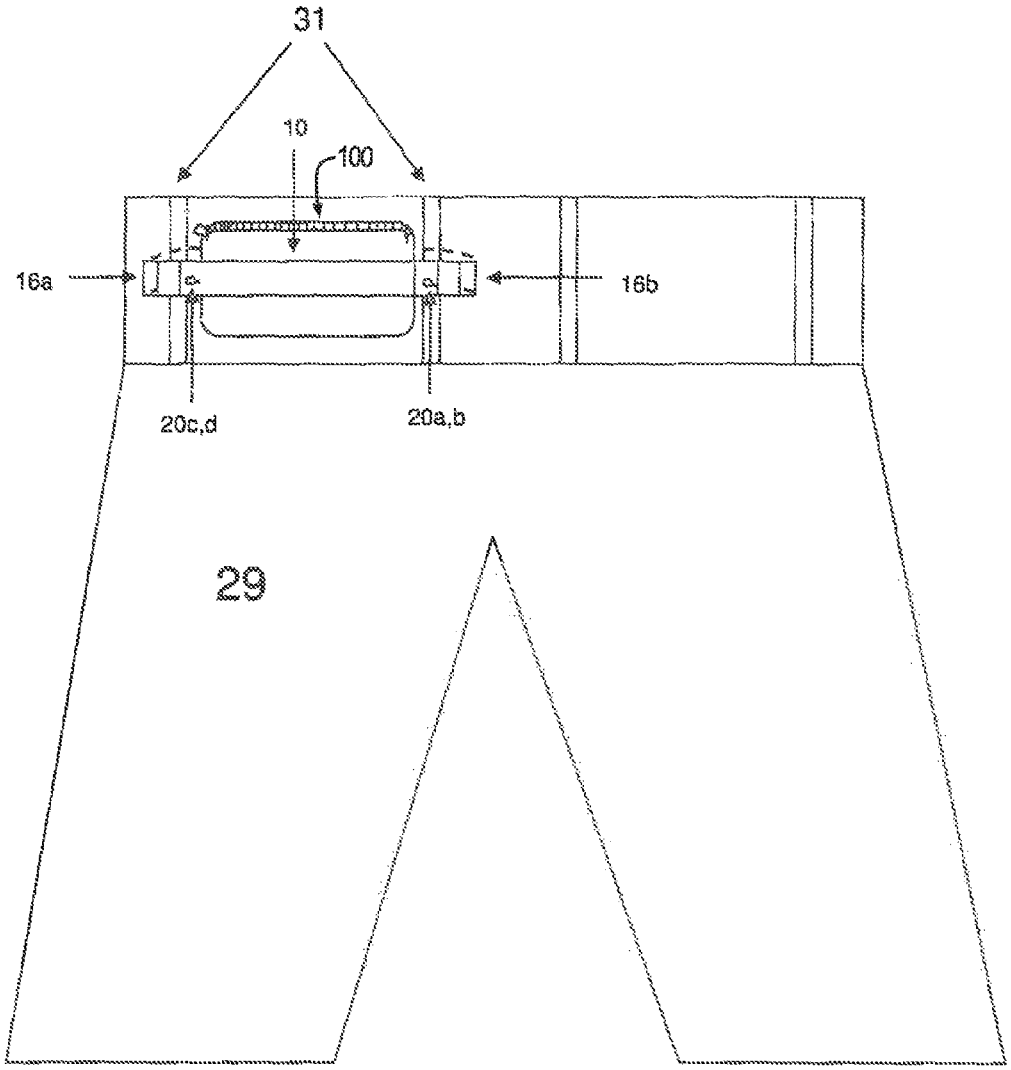
FIG. 4 shows the carrying case of FIG. 1 attached in place through belt loops of the pants to the user's waist in accordance with one embodiment of the current disclosure.

FIG. 4 shows the appearance of the carrying case 100 in use. The pouch 10, is attached and secured to a person's pants by threading the permanently-attached left side 16*a* and right side 16*b* though belt loops 31, pulling each across the front of the pouch 10, as shown in FIGS. 2 and 3 and described above, wrapping the belt 11 around the belt loops and fastening left side 16*a* and right side 16*b* in place at components 20*a,b* and components 20*c,d*, respectively. This type of carrying case 100 with a waterproof pouch 10 securely carries a phone or other handheld device or other personal item held in the pouch 10, protecting the phone, handheld device, or other personal item from water and other damage when a user desires to carry the phone, handheld device, or other personal item during physical activity, such as horseback riding, but the zipper 12 located across the top 14 allows for easy access to the phone, handheld device, or other personal item when needed. The phone may be a smart phone and the pouch 10 may be sized to accept both the phone and a protective case for the phone, and may be sized to accept multiple personal items together. The ability to securely attach the phone to a horseback rider's waistband is preferable to attaching the phone, handheld device, or other personal item to the rider's arm or leg, as these areas are difficult areas to access when riding, are uncomfortable areas to carry a phone, handheld device, or other personal item due to the nature of the activity, and predispose the phone, handheld device, or other personal item to significant damage in the event of a fall. Other types of cell phone holders that attach at the waist at a single point are not secure, and bounce during riding. Therefore these other types of cell phone holders are uncomfortable to wear, and more importantly, they easily fall off. Some of these other types of cell phone holders also do carry items other than a cell phone. The adjustable belt 11 with left side 16*a*, right side 16*b*, components 18*a,b*, slides 22*a,b*, and components 20*a,b,c,d* described above, allows the cell phone, handheld device, or other personal item to be securely and firmly attached to the pants of a user at the waist while preventing annoying bouncing and detachment during riding or detachment and damage in the event of a fall. In various embodiments, components 20*a,b,c,d* may be snap fasteners, buttons, hook and loop fasteners (commonly sold in association with the trademark Velcro™), mushroom-shaped reclosable fasteners (commonly sold in association with the trademark Dual Lock™), D-rings, or any other fastening device capable of connecting the right side 16*b* of belt 11 to the left side 16*a* of belt 11.

Figure 5:
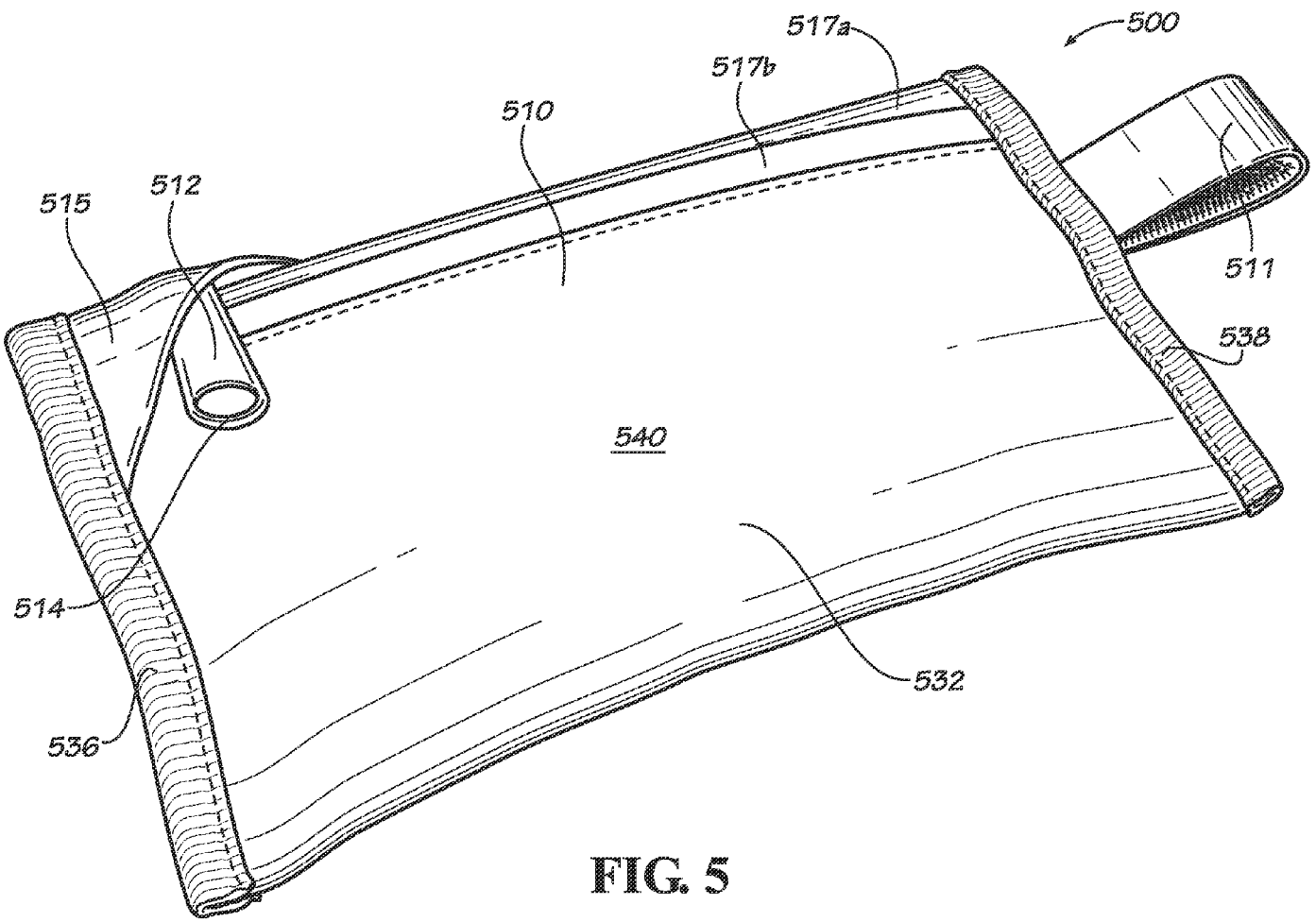
FIG. 5 is a perspective view of a carrying case in accordance with one embodiment of the current disclosure.

Another embodiment of a carrying case 500 is disclosed and described in FIG. 5. In the current embodiment, carrying case 500 includes a pouch 510 and a belt 511. The pouch 500 may be rectangular in shape and of a size that can accommodate any currently-available mobile device or similarly-sized handheld device such as an iPod™. The pouch 500 may be made from waterproof material, such as taslan or neoprene, and can either be soft or rigid. The pouch 510 includes a front side 532, a back side 534 (shown in FIG. 7), a left side 536, and a right side 538. The front side 532 and the back side 534 define an outer surface 540. The left side 536 and the right side 538 are closed at each end with a bound seam, though other seams may be present in various embodiments, and the left side 536 and the right side 538 may be closed by other methods in various embodiments. The belt 511 is a single polypropylene strap in the current embodiment, though the belt 511 may be formed from other materials in various embodiments, such as water-repellent grosgrain, and may be multiple straps or other belt types, such as rope, in various embodiments.

A zipper 512 is positioned proximate to a top side 542 (shown in FIG. 6) of the pouch 510 and is opened and closed with a pull tab 514. The pull tab 514 may be nested in a zipper garage 515 attached to the pouch 510 at one end of the zipper 512. The zipper garage 515 is attached to the pouch 510 such that the pull tab 514 nests in the zipper garage 515 when the zipper 512 is in the closed position, thereby preventing leaks through the zipper 512 and holding the pull tab 514 in place during jostling of the carrying case 500. The zipper 510 is also waterproof, including an upper zipper seal 517*a* and a lower zipper seal 517*b*. The upper zipper seal 517*a* and the lower zipper seal 517*b* are formed from a waterproof material and seal against each other when the zipper 512 is in the closed position.

Figure 6:
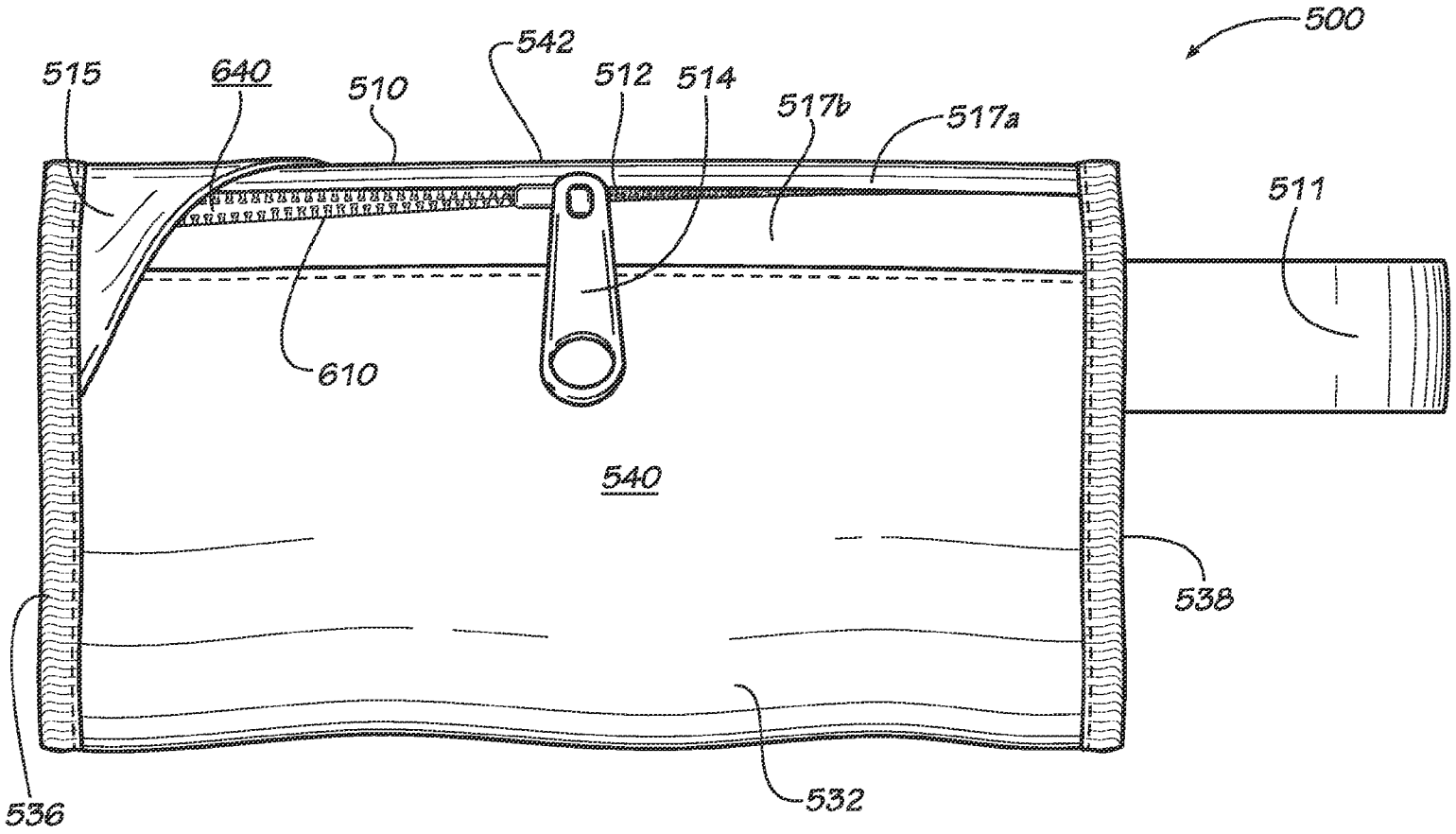
FIG. 6 is a front view of the carrying case of FIG. 5 showing a zipper of the carrying case in a partially open position.

FIG. 6 shows the carrying case 500 with the zipper 512 in a partially open position. An inner surface 640 is shown through the zipper 512. The zipper 512 covers an opening 610 defined by the inner surface 640 and the outer surface 540. The opening 610 is sized to accept personal items such as mobile phones to be carried within the pouch 510.

Figure 7:
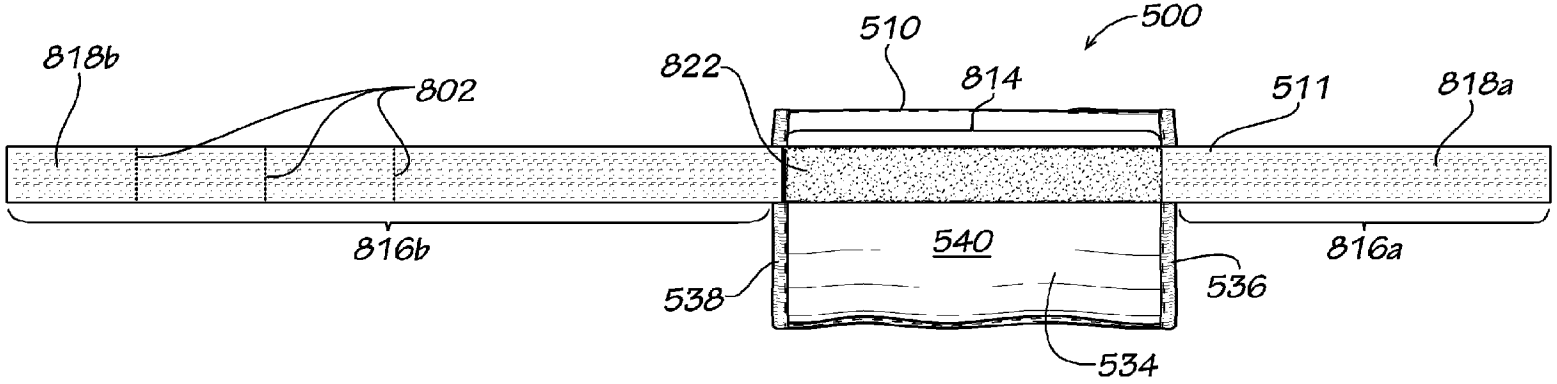
FIG. 7 is a back view of the carrying case of FIG. 5 showing a belt of the carrying case in an unconnected position.

FIG. 7 shows a back view of the carrying case 500 with the belt 511 in an unconnected position. In the current embodiment, the back side 534 of the pouch 510 is vinyl to prevent slippage of the pouch 510 against the clothes of a user, though other materials may be used in various embodiments. The belt 511 is attached to the back side 534 of pouch 510, and includes left side 816*a*, a right side 816*b*, and a middle section 814. The left side 816*a* is a first end of the belt 511 and the right side 816*b* is a second end of the belt 511. The left side 816*a* includes an inner side 818*a* and an outer side 820*a* (shown in FIG. 8). The right side 816*b* includes an inner side 818*b* and an outer side 820*b* (shown in FIG. 8). The middle section 814 includes an inner side 822 and an outer side 824 (not shown). The outer side 824 contacts the outer surface 540 of the pouch 510 on the back side 534. In the current embodiment, the middle section 814 is sewn to the back side 534 of the pouch 510, though the belt 511 may be attached to the pouch 510 by other methods in various embodiments, such as snaps, buttons, hook and loop fasteners, or being formed integrally with the pouch 510, and various locations on the belt 511 may be connected to various locations of the pouch 510 in various embodiments, and the connection of the middle section 814 of the belt 511 to the back side of the pouch 510 by sewing should not be considered limiting. The right side 816*b* also includes a plurality of seams 802 spaced along the length of the right side 816*b* in the current embodiment. In the current embodiment, there are three seams 802. However, there may be any number of seams 802, including zero, in various embodiments.

Figure 8:
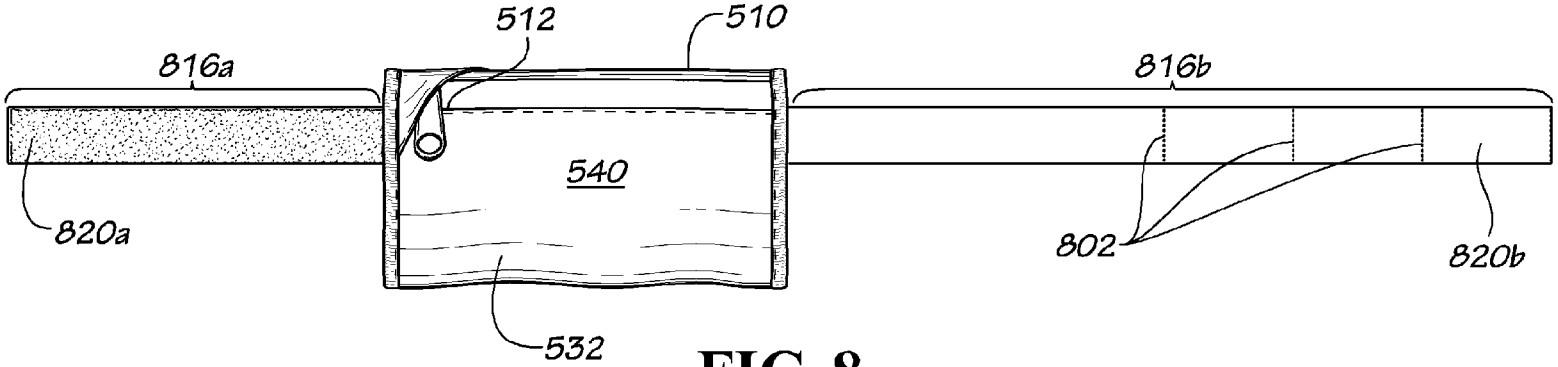
FIG. 8 is a front view of the carrying case of FIG. 5 showing the belt of the carrying case in the unconnected position of FIG. 7.

As shown in FIG. 7, the inner side 818*a* and the inner side 818*b* include a plurality of hooks, and the inner side 822 includes a plurality of loops. As shown in FIG. 8, the outer side 820*a* includes a plurality of loops and the outer side 820*b* does not include either hooks or loops. The combination of these hooks and loops form hook and loop fasteners and may be fastened to each other by bringing the hooks and loops into contact with each other. The hook and loop fasteners may be used to connect the left side 816*a* to the right side 816*b* and to connect the left side 816*a* to the middle section 814.

Figure 9:
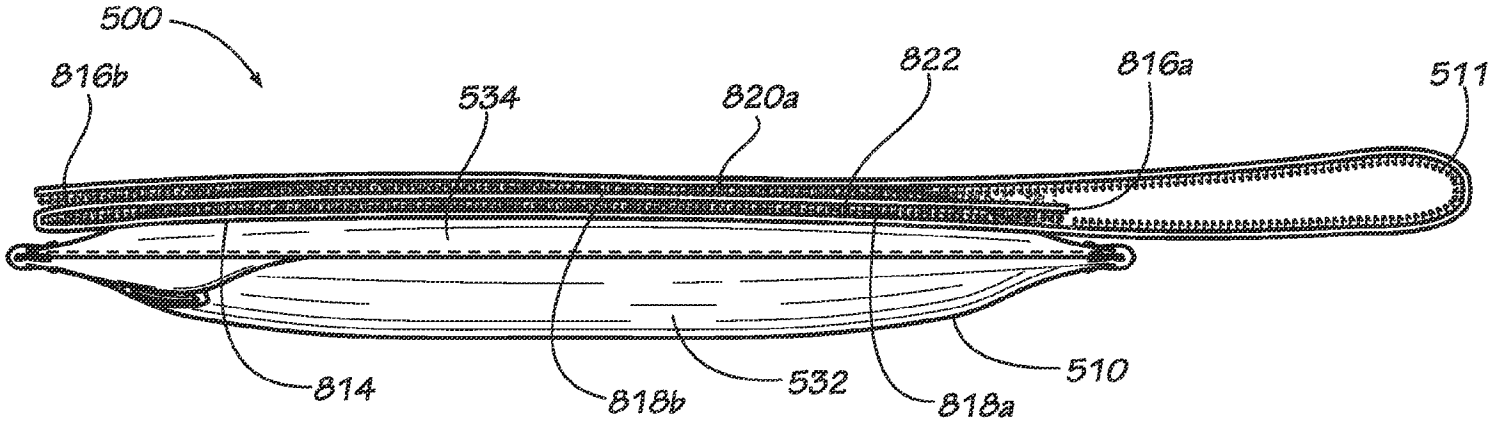
FIG. 9 is a top view of the carrying case of FIG. 5 showing the belt of the carrying case in a connected position with the carrying case unattached to a user.

FIG. 9 shows a top view of the carrying case 500 with the belt 511 in an unattached position. In the unattached position, the carrying case 500 is not attached to a user. As shown in FIG. 9, the inner side 818*a* of the left side 816*a* is connected to the inner side 822 of the middle section 814 with hook and loop fasteners and the outer side 820*a* of the left side 816*a* is connected to the inner side 818*b* of the right side 816*b* by hook and loop fasteners. Thus, the left side 816*a* is connected both to the middle section 814 and the right side 816*b* and thereby connects the middle section 814 to the right side 816*b*.

Figure 10:
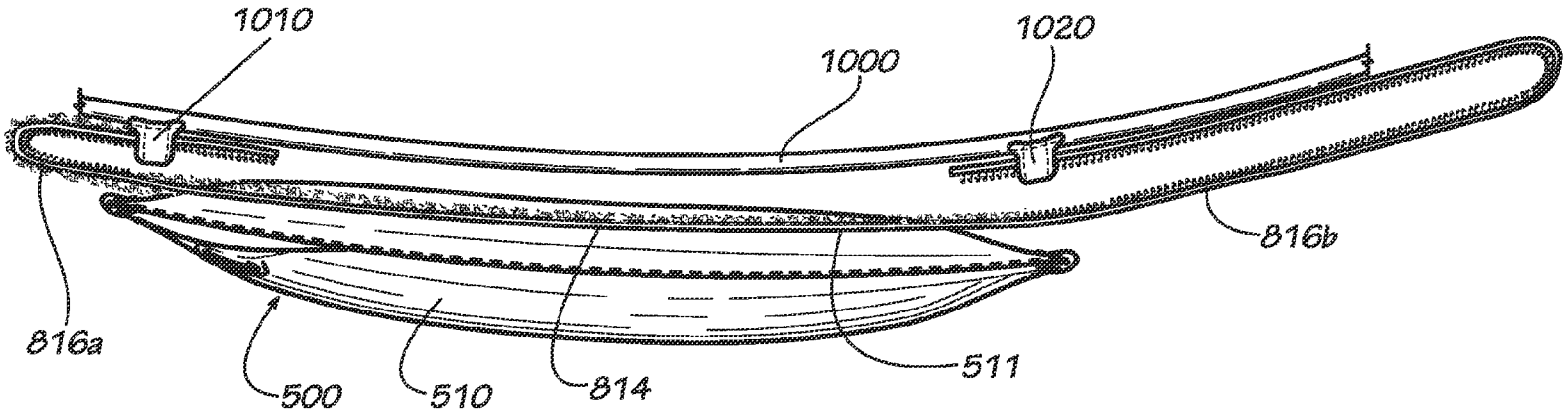
FIG. 10 is a top view of the carrying case of FIG. 5 showing the belt of the carrying case being inserted into belt loops on the waist of a user.

FIG. 10 shows a top view of the carrying case 500 in the process of being attached to a user's pants 1000 at the user's waist. The pants 1000 include a plurality of belt loops including a first belt loop 1010 and a second belt loop 1020. The pair of belt loops 1010,1020 are adjacent to each other on the waist of the user, i.e. there are no other belt loops between the pair of belt loops 1010,1020, and both belt loops 1010,1020 are on one side of the waist of the user. The left side 816*a* of the belt 511 is wrapped around the first belt loop 1010 by threading the left side 816*a* through the first belt loop 1010 towards the second belt loop 1020 such that the belt 511 has a portion on the exterior of the first belt loop 1010 and a portion in the interior of the first belt loop 1010 between the first belt loop 1010 and the waist of the user, thereby folding the left side 816*a* back in on itself. Likewise, the right side 816*b* of the belt 511 is wrapped around the second belt loop 1020 by threading the right side 816*b* through the second belt loop 1020 towards the first belt loop 1010 such that the belt 511 has a portion on the exterior of the second belt loop 1020 and a portion in the interior of the second belt loop 1020 between the second belt loop 1020 and the waist of the user, thereby folding the right side 816*b* back in on itself.

Figure 11:
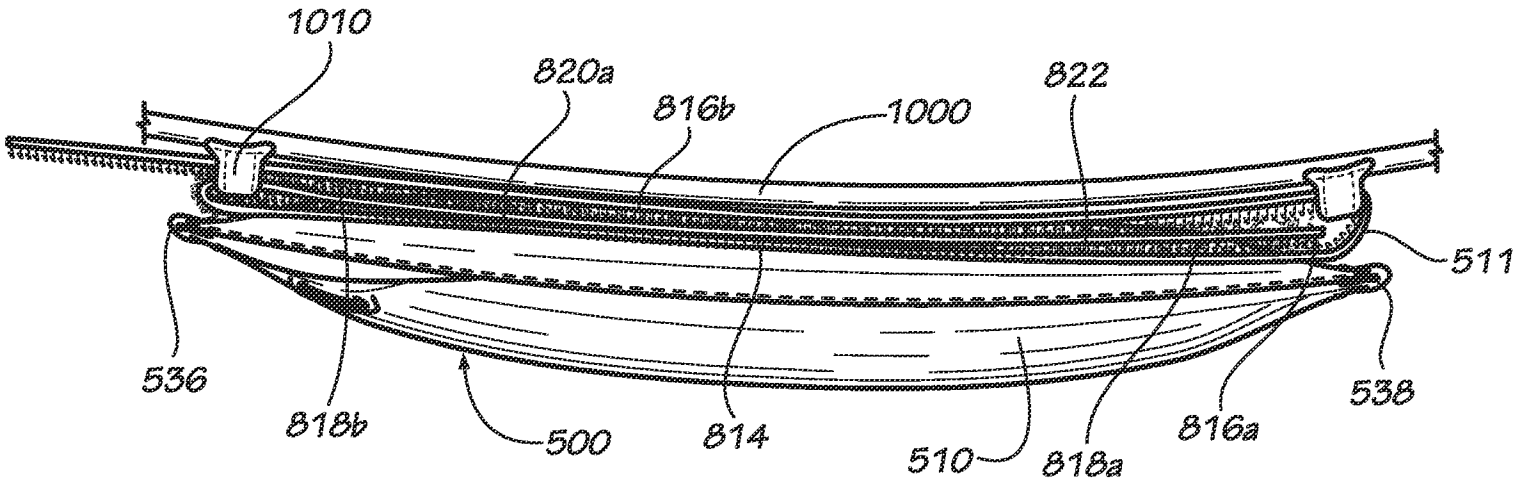
FIG. 11 is a top view of the carrying case of FIG. 5 showing the belt of the carrying case in a connected position with the carrying case attached to the waist of a user.

FIG. 11 shows a top view of the carrying case 500 securely attached to the user's pants 1000. Once the left side 816*a* is wrapped around the first belt loop 1010, the left side 816*a* is pulled and tightened until the left side 816*a* is tightly wrapped around the first belt loop 1010. Then the inner side 818*a* of the left side 816*a* is placed against the inner side 822 of the middle section 814 to connect the left side 816*a* to the middle section 814 by the hook and loop fasteners. Thereafter, the right side 816*b* is pulled and tightened until the right side 816*b* is tightly wrapped around the second belt loop 1020. In various embodiments, the right side 816*b* may be threaded through the first belt loop 1010 during tightening or may be pulled above or below the first belt loop 1010 if the right side 816*b* is pulled beyond the first belt loop 1010 when tightening the right side 816*b* around the second belt loop 1020. Then the inner side 818*b* of the right side 816*b* is placed against the outer side 820*a* of the left side 816*a* to connect the right side 816*b* to the left side 816*a* by the hook and loop fasteners. The left side 816*a* and the right side 816*b* are thereby connected to each other between the pouch 510 and the waist of the user and between the first belt loop 1010 and the second belt loop 1020.

In the current embodiment, when the carrying case 500 is securely attached to the user's pants 1000, a portion of the right side 816*b* may extend beyond the first belt loop 1010 and the left side 536 of the pouch 510. This portion may be shortened by cutting the portion off with scissors or by other methods. In the current embodiment, the seams 802 prevent the rest of the belt 511 from unraveling inwards from the seam 802 inward of the cut, though the seams 802 may not be present in various embodiments.

Figure 12:
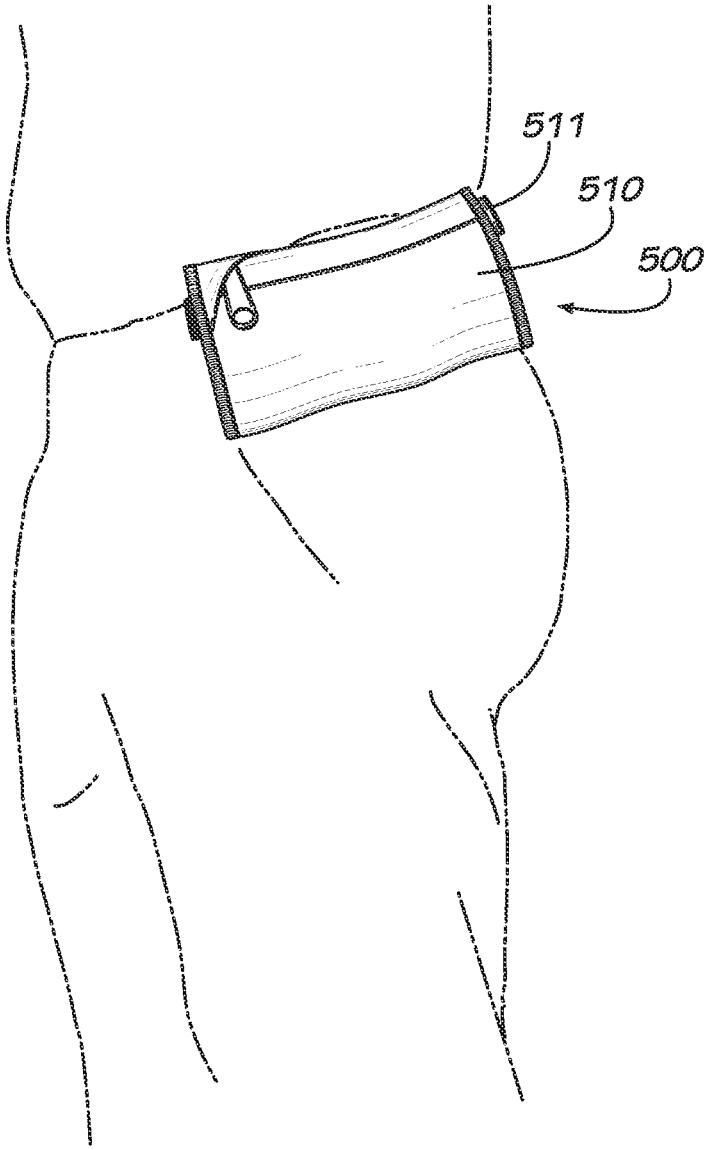
FIG. 12 is a perspective view of the carrying case of FIG. 5 attached to the waist of a user.

FIG. 12 shows the carrying case 500 securely attached to the waist of the user. As shown in FIG. 12, the belt 511 does not wrap all the way around the waist of the user and the carrying case 500 does not hang from the waist, but rather, the carrying case 500 is securely attached to the waist to prevent jostling of the pouch 510 during activity of the user.

In various embodiments, the right side 816*b* of the belt 511 may be a separate strap from the left side 816*a* of the belt 511, thereby making the belt 511 two separate connectable straps, with the right side 816*b* attached to the pouch 510 at a separate location on the pouch 510 from the left side 816*a*, such as with the right side 816*b* of the belt 511 attached to the right side 538 of the pouch 510 and the left side 816*a* of the belt 511 attached to the left side 536 of the pouch 510, or the left side 816*a* and the right side 816*b* both attached to the back side 534 of the pouch 510. In various embodiments, the middle section 814 may not connect to the left side 816*a* or the right side 816*b* during attachment to the waist of a user. In various embodiments, the left side 816*a* or the right side 816*b* may wrap around both the first belt loop 1010 and the second belt loop 1020 and connect directly to the pouch 510 or to another end of the belt 511. In various embodiments, the left side 816*a* and the right side 816*b* may be connected by methods other than, or in combination with, hook and loop fasteners, such as buttons, snaps, ties, D-rings, mushroom-shaped reclosable fasteners, etc. In various embodiments, the first belt loop 1010 and the second belt loop 1020 may not be adjacent, but may have one or more belt loops between the pair of belt loops 1010,1020. In various embodiments, the first belt loop 1010 and the second belt loop 1020 may not be on one side of the waist of the user. In various embodiments, the carrying case 500 may include an extender that may be connected to the belt 511 to allow the belt 511 and the extender in combination to be alternatively wrapped around a user's waist similar to a fanny pack if the user does not have belt loops. In other embodiments, the belt 511 may be removable from the pouch 510 to allow the extender to be attached to the pouch 510.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and subcombinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A carrying case wearable by a user, the carrying case comprising:

a pouch having an inner surface and an outer surface, the inner surface defining an interior carrying chamber, the inner surface and the outer surface defining an opening to provide access to the interior carrying chamber; and a belt connected to the pouch, the belt sized to wrap around and thread through a pair of belt loops on a waist of the user, the belt including a first end and a second end, the first end connectable to the second end.

2. The carrying case of claim 1, wherein the belt is a single strap.

3. The carrying case of claim 1, wherein the first end is connectable to the second end by hook-and-loop fasteners.

4. The carrying case of claim 1, wherein the first end is connectable to the second end between the pouch and the waist of the user.

5. The carrying case of claim 1, wherein:

the belt is sized for the first end to wrap around a first belt loop of the pair of belt loops and for the second end to wrap around a second belt loop of the pair of belt loops; and the belt is sized such that the first end and the second end are connectable between the first belt loop and the second belt loop.

6. The carrying case of claim 1, wherein the first end is connectable to a middle section of the belt.

7. The method of claim 6, wherein the first end and second end are each connectable to a middle section of the belt by hook-and-loop fasteners.

8. The carrying case of claim 1, wherein the pair of belt loops are on one side of the waist of the user.

9. The carrying case of claim 1, wherein the pair of belt loops are adjacent to each other on the waist of the user.

10. The carrying case of claim 1, wherein the pouch includes water-repellant fabric and a water-repellant zipper, the opening closeable by the zipper.

11. The carrying case of claim 1, wherein the interior carrying chamber is sized to securely carry a cell phone.

12. A method of using a carrying case having a pouch and a belt connected to the pouch, the method comprising:

wrapping the belt around and threading the belt through a pair of belt loops on one side of a waist of a user, the belt including a first end and a second end; and securing the carrying case to the waist of the user at least partly by connecting the first end to the second end.

13. The method of claim 12, wherein securing the carrying case to the waist of the user includes connecting the first end of the belt to the second end of the belt between the pair of belt loops.

14. The method of claim 12, wherein securing the carrying case to the waist of the user includes connecting the first end to the second end between the waist of the user and the pouch.

15. The method of claim 12, wherein securing the carrying case to the waist of the user includes connecting the first end to the second end with hook and loop fasteners.

16. The method of claim 12, wherein:

the belt includes a middle section connected to the pouch; and securing the carrying case to the waist of the user includes connecting the first end to a middle section of the belt.

17. The method of claim 16, wherein securing the carrying case to the waist of the user includes connecting the first end to the middle section of the belt with hook and loop fasteners.

18. The method of claim 12, wherein the pouch defines an interior carrying chamber sized to securely carry a cell phone, the method further comprising placing a smart phone inside the interior carrying chamber such that the smart phone is held in place.

19. The method of claim 12, wherein the pair of belt loops are adjacent to each other on the waist of the user.

20. The method of claim 12, wherein the first end of the belt is a left side of the belt and the second end of the belt is a right side of the belt, wherein securing the carrying case to the waist of the user includes pulling and tightening the left side until the left side is tightly wrapped around a first belt loop of the pair of belt loops and pulling and tightening the right side until the right side is tightly wrapped around a second belt loop of the pair of belt loops, the carrying case secured above a bottom edge of the first belt loop and above a bottom edge of the second belt loop.

* * * * *